US005339966A

United States Patent [19]

Bastiaans

[11] Patent Number: 5,339,966

[45] Date of Patent: Aug. 23, 1994

[54] DEVICE FOR LOCKING AND MOUNTING A FIRE ARM

[75] Inventor: Richard G. Bastiaans, Saugus, Calif.

[73] Assignee: R L Industries Inc., Valencia, Calif.

[21] Appl. No.: 144,977

[22] Filed: Oct. 27, 1993

[51] Int. Cl.[5] ..... A47F 7/00

[52] U.S. Cl. ..... 211/4; 211/64

[58] Field of Search ..... 211/4, 64, 94, 70.8

[56] References Cited

U.S. PATENT DOCUMENTS

| | | | |
|---|---|---|---|
| 2,946,452 | 7/1960 | Caloiero et al. . | |
| 3,291,317 | 12/1966 | Bowen . | |
| 3,507,398 | 4/1970 | Schaefer | 211/64 X |
| 3,618,785 | 11/1971 | Newman . | |
| 3,643,811 | 2/1972 | Howerton . | |
| 3,731,817 | 5/1973 | Fowlkes et al. . | |
| 3,767,093 | 10/1973 | Pinkerton . | |
| 3,857,491 | 12/1974 | Townsend et al. | 211/64 X |
| 4,182,453 | 1/1980 | Worswick . | |
| 4,450,989 | 5/1984 | Bogar, Jr. . | |
| 4,596,334 | 6/1986 | Daulton | 211/64 |
| 4,624,372 | 11/1986 | Brolin | 211/64 X |
| 4,648,516 | 3/1987 | Elkins . | |
| 4,961,505 | 10/1990 | Moeller | 211/94 X |

*Primary Examiner*—Alvin C. Chin-Shue
*Assistant Examiner*—Sarah A. Lechok
*Attorney, Agent, or Firm*—Robbins, Berliner & Carson

[57] ABSTRACT

An device for securing a fire arm has a base with a floor and two upstanding sidewalls, each sidewall defining a groove adjacent the floor. The device also has a first member pivotally mounted between the two sidewalls, a second member slidable in the grooves and adapted to couple with the first member to lock the fire arm between two protruded parts of the fire arm, a lock pin for locking the second member and a lock for locking the lock pin. The floor has at least one through-holes each for passage of a fastener, each through-hole being disposed under at least one of the first member and the second member, so that the fastener is inaccessible when the device is in use.

18 Claims, 3 Drawing Sheets

DEVICE FOR LOCKING AND MOUNTING A FIRE ARM

TECHNICAL FIELD OF THE INVENTION

The present invention relates in general to a device for mounting and locking a fire arm.

BACKGROUND OF THE INVENTION

Many people who own fire arms, such as rifles having vintage characteristics, like to mount the fire arms on display. However, unless locked adequately, the fire arms on display may be stolen.

SUMMARY OF THE INVENTION

The present invention provides a device for mounting a fire arm. The device according to the present invention has a base with a floor and two upstanding sidewalls. The floor has at least one hole for passage of a fastener for mounting the device to a mounting surface. Each of the sidewalls defines a groove adjacent the floor. The device also includes a holding member for holding the fire arm. The holding member is adapted to be slidable between the upstanding sidewalls and has a pair of outwardly-directed flanges slidable in the grooves. The device also has means for fastening the holding member to the base. According to the present invention, the fastener and the fastening means are inaccessible when the device is in use, making it difficult to remove the device from the mounting surface or to remove the fire arm from the device.

According to another aspect, the present invention provides a fire arm locking device which has a base with a floor and two upstanding sidewalls. Each of the upstanding sidewalls defines a groove adjacent the floor. The device also has a first member pivotally mounted between the two sidewalls, a second member having flanges slidable in the grooves and adapted to couple with the first member to surround the fire arm between two protruded parts (e.g., the trigger housing and the butt stock) and deny passage of the protruded parts therethrough. The device also has a third member for locking the second member and a lock for locking the third member.

DESCRIPTION OF THE PREFERRED EMBODIMENT

Figure 1:
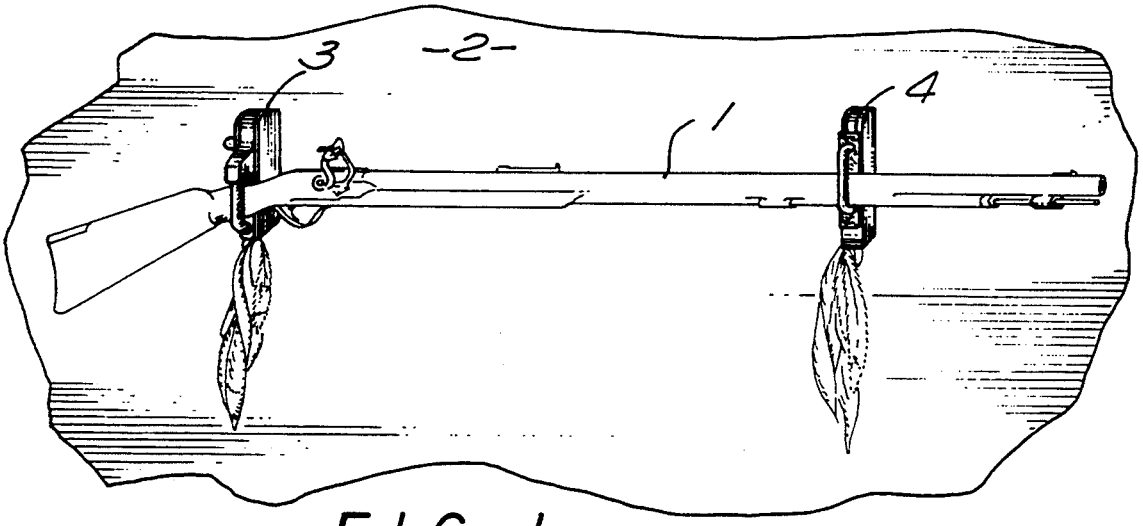
FIG. 1 depicts a fire arm secured by an embodiment of the present invention.

FIG. 1 shows a fire arm 1, such as a rifle having a stock and a barrel, and supported by a support device 3-4 mounted to a mounting surface 2 (e.g., a wall). The firearm is supported and locked by a locking device 3 and supported by a barrel or fore-end supporting device 4.

Figure 2:
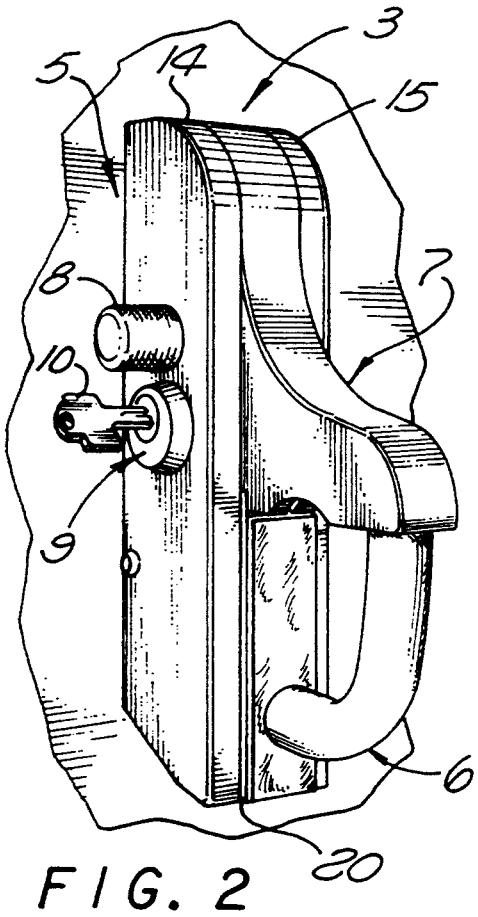
FIG. 2 depicts the locking device in a locked state.

FIG. 2 shows the locking device 3 in a locked state. The locking device 3 has a base 5, a pivoted member 6, a slidable member 7, a lock pin 8 (e.g., a dead bolt), and a lock 9 operable by a key 10. The locking device 3 locks the fire arm 1 between the butt stock and the trigger housing of the fire arm 1. The slidable member 7 and the pivoted member 6 couple with each other to deny passage of the butt stock and the trigger housing of the fire arm 1 and deny movement of the fire arm away from the locking device 3.

Figure 3:
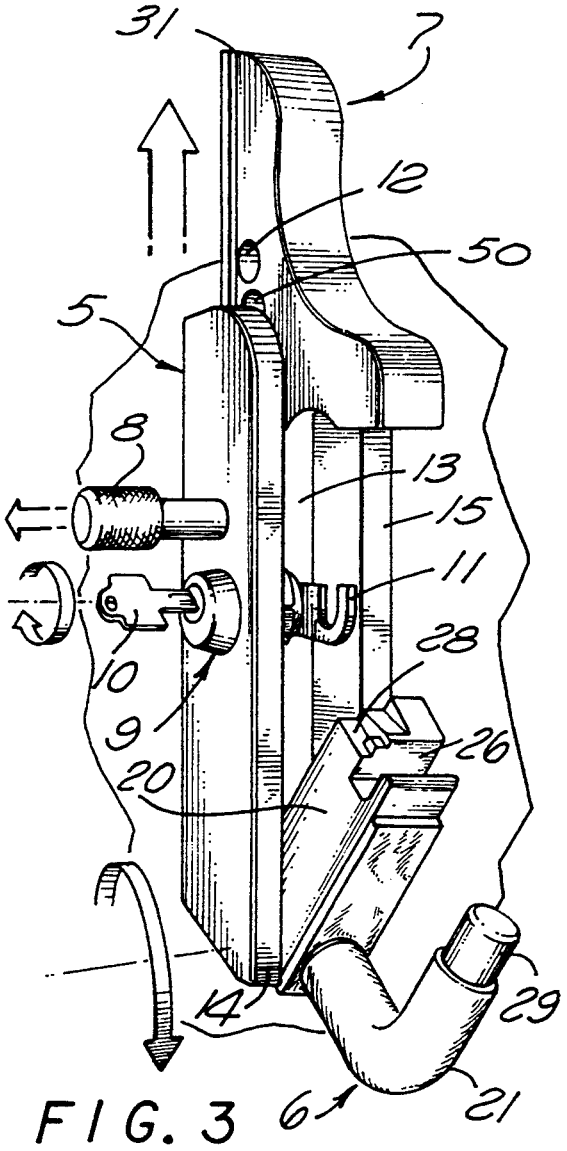
FIG. 3 depicts the locking device in an unlocked state.

With reference to FIG. 3, to unlock the locking device 3, the lock 9 is turned by the key 10. The lock pin 8 passes through a through-hole 12 in the slidable member 7 and inhibits movement thereof. The lock pin 8 is in turn locked by a hook 11 which rotates with the movement and in the direction of the key 10. When the key 10 is turned, the hook 11 disengages from the lock pin 8. When the lock pin 8 is disengaged, the lock pin 8 can be pulled away from the through-hole 12. After the lock pin 8 is pulled, the slidable member 7 is slidable upwardly and disengaged from the pivoted member 6. After disengagement with the slidable member 7, the pivoted member 6 can be rotated away from the base 5 and the fire arm can be easily removed.

Figure 4:
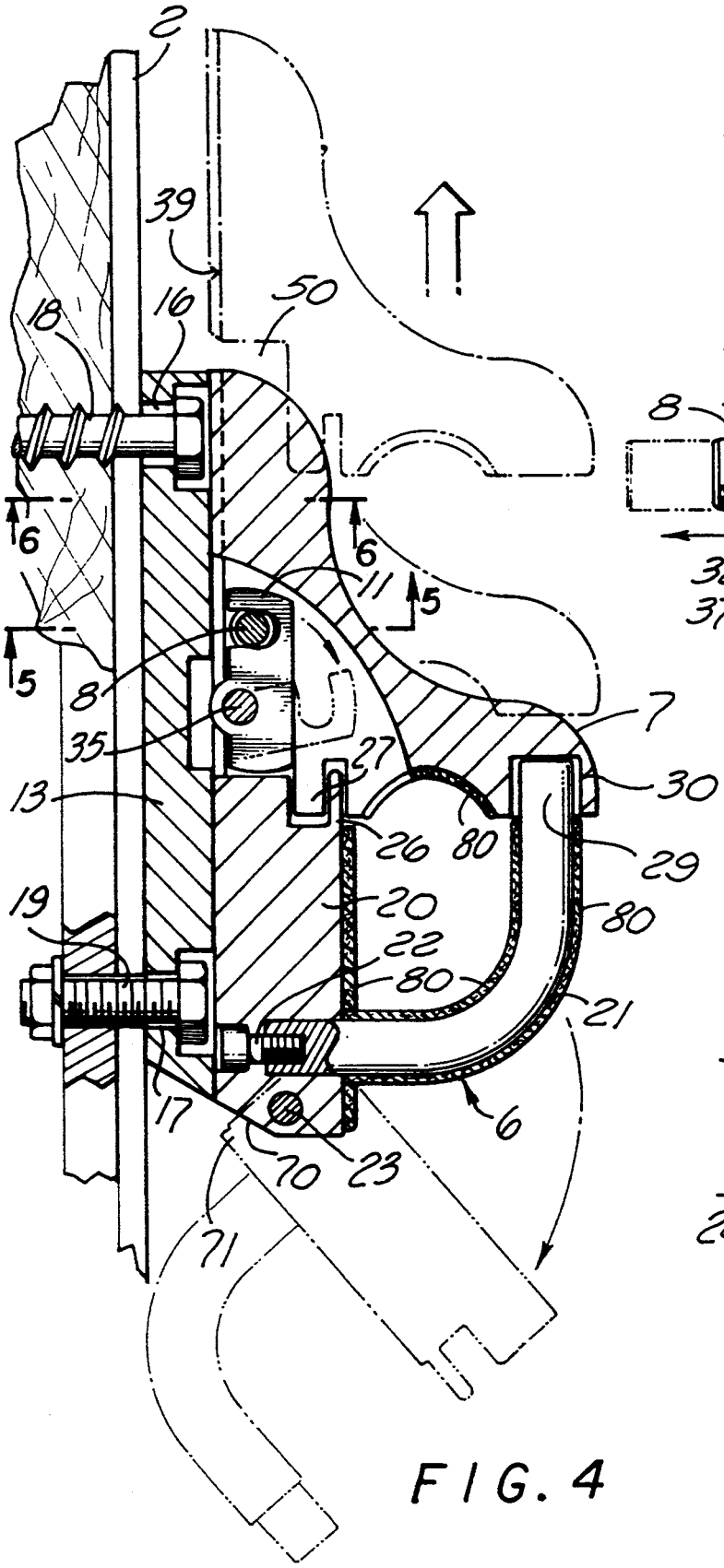
FIG. 4 is a cross-sectional view of the locking device of FIG. 3 showing how the slidable member, the pivoted member, the dead bolt and the lock are coupled.

The base 5 of the locking device 3 has a floor 13 and a pair of upstanding sidewalls 14 and 15. With reference to FIG. 4, the floor 13 has at least two through-holes 16 and 17 for providing passage of fasteners 18 and 19 for mounting the locking device 3 to the mounting surface 2. Fastener 18 is represented in FIG. 4 by a screw for mounting to a wooden mounting surface. Fastener 19 is represented in FIG. 4 by a bolt for mounting to a metal mounting surface. The difference is deliberately made to show that different kinds of fasteners can be used, depending upon the type of surface to be mounted on. In general, both fastener 18 and 19 would be of the same type if the mounting surface is made of the same material. The through-holes 16 and 17 are preferably positioned at as close to the ends of the base 5 as possible in order to make it more difficult for someone to pry the base 5 from the mounting surface 2. Moreover, the through-holes 16 and 17 are positioned under at least one of the slidable member 7 and the pivoted member 6 so that the fasteners 18 and 19 are blocked by either the slidable member 7 or the pivoted member 6 and thereby become inaccessible when the locking device 3 is locked.

The pivoted member 6 includes a hinge 20 and a L-shaped bar 21. The bar 21 is mounted to the hinge 20 by a bolt 22 and combines with the hinge 20 to form a U-shape holder for holding the fire arm 1. The hinge 20 is pivotally mounted between the two sidewalls 14 and 15 by a pivot pin 23 so that the pivoted member 6 can rotate to and from the floor 13. The pivot pin 23 is affixed (e.g., by welding) to the sidewalls 14 and 15 at one end of the base 5. Referring to FIG. 4, when the pivoted member 6 rotates away from the base 5, room must be provided for the rotational movement of the lower corner 71 of the hinge 20. Accordingly, edge 70 of the base 5 is inclined and the pivot pin 23 is protruded as shown in FIG. 4 to provide such room. However, the inclination should be small in order not to let someone use the inclination to pry the base 5 away from the mounting surface 2.

The hinge 20 of the pivoted member 6 has a toothed tip section (such as a tongue) 26 for engaging a counterpart toothed section (such as a groove) 27 at the tip of the slidable member 7 to thereby inhibit movement of the pivoted member after engagement with the slidable member 7. The end of the hinge has a cutoff section 28 (see FIG. 3) for accommodating the lock 9 and the hook 11. A cutoff section 50 is also provided in the slidable member 7 to accommodate the lock 9.

Preferably, the tip 29 of the bar 21 is long enough to be insertable into a hole 30 in the slidable member 7 when the locking device 3 is locked. This is to prevent someone from prying the bar 21 open. However, since the pivoted member 6 is already locked by the respective toothed sections 26 and 27 of the pivoted member 6 and the slidable member 7, a gap can be provided between the tip of the bar 21 and the end of the slidable member 7 to allow a more complete view of the fire arm 1, provided that such gap is small enough not to allow the fire arm to be removed.

Figure 5:
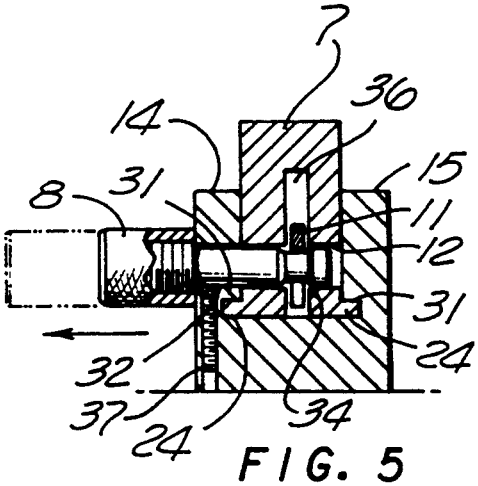
FIG. 5 is a cross-sectional view of the locking device from line 5—5 of FIG. 4 showing how the slidable member and the dead bolt are locked.
Figure 6:
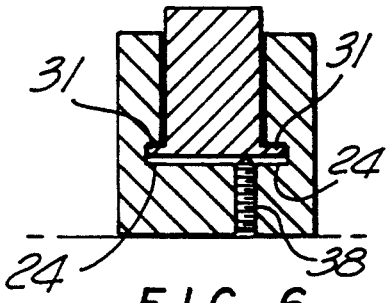
FIG. 6 is a cross-sectional view of the locking device from line 6—6 of FIG. 4 showing how the slidable member is detained when the locking device is unlocked.

As shown in FIGS. 5 and 6, the upstanding sidewalls 14 and 15 each define a groove 24 therein adjacent the floor 13. The grooves 24 are provided for receiving respective ones of a pair of outwardly-directed flanges 31 on the bottom of the slidable member 7. The grooves 24 of the upstanding sidewalls 14 and 15 and the flanges 31 of the slidable member 7 operate to deny perpendicular movement of the slidable member 7 away from the base 5 when the flanges 31 are received within the grooves 24.

At least one of the upstanding sidewalls 14 and 15 has a through-hole 32 for receiving the lock pin 8. The lock pin 8 operates to lock the slidable member 7 in place when the slidable member 7 has been moved into the locked position. The slidable member 7 has a through-hole 12 which is coaxial with the through-hole 32 of the upstanding sidewall 14 of the base 5 when the slidable member 7 has been moved into the locked position. When the slidable member 7 is in the locked position, the lock pin 8 is inserted through the through-holes 32 and 12 to deny movement of the slidable member 7. With reference to FIG. 5, a reduced diameter section 34 is defined at a point (e.g., about midway) of the lock pin 8. The reduced diameter section 34 is provided to receive the hook 11 of the lock 9. The lock 9 is locked/unlocked by rotating the key 10.

To lock the locking device 3, the key 10 is turned (e.g., counter-clockwise as in the shown embodiment) to rotate the hook 11 until it engages the reduced diameter section 34 of the lock pin 8 and thereby denies lateral movement of the lock pin 8. To provide room for the hook 11 to rotate, a groove 36 (see FIG. 5) is provided in the slidable member 7.

To unlock the locking device 3, the key 10 is turned (e.g., clockwise as in the shown embodiment) to disengage the hook 11 from the reduced diameter section 34 of the lock pin 8. After the hook 11 clears the reduced diameter section 34, the lock pin 8 can be pulled out. A first spring-loaded retainer pin 37 is provided to retain the lock pin 8 when it is pulled out. When the reduced diameter section 34 of the lock pin 8 is pulled to the position of the first retainer 37, the retainer 37 is urged into the reduced diameter section 34 and holds the lock pin 8 in place.

When the lock pin 8 is pulled out of the throughhole 12, the slidable member 7 can be moved away from the pivoted member 6. With reference to FIG. 6, a second spring-loaded retainer 38 is preferably provided at the floor 13 of the base 5 to hold the slidable member 7 in an unlocked position. The second retainer 38 holds the slidable member 7 in the unlocked position by engaging a notch 39 (see FIG. 4) on the slidable member 7. The availability of the retainer 38 to hold to slidable member 7 in the unlocked position facilitates the removal of the fire arm 1.

In addition to the securing device 3, a fore-end support device 4 is provided to hold the fire arm 1 on the mounting surface 2.

Figure 7:
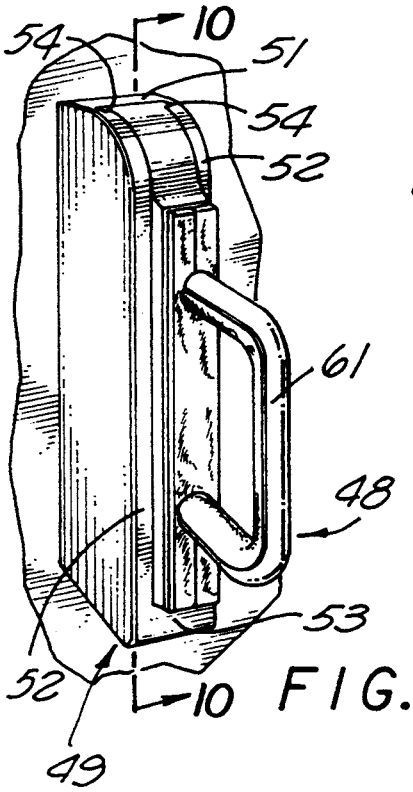
FIG. 7 is a diagram of the barrel or fore-end support device.

With reference to FIG. 7, the fore-end support device 4 has a slidable member 48 and a base 49.

The slidable member 48 has a U-shape bar 61 mounted thereon. The opening formed by the U-shape bar 61 and the slidable member 48 is used for supporting the fore-end portion of the fire arm 1.

The base 49 of the fore-end support device 4 has a floor 51, two upstanding sidewalls 52 and an upstanding end wall 53. The upstanding sidewalls 52 each define a groove 54 therein adjacent the floor 51. The grooves 54 are provided for receiving respective ones of a pair of outwardly directed flanges 55 on the bottom of the slidable member 48.

Figure 8:
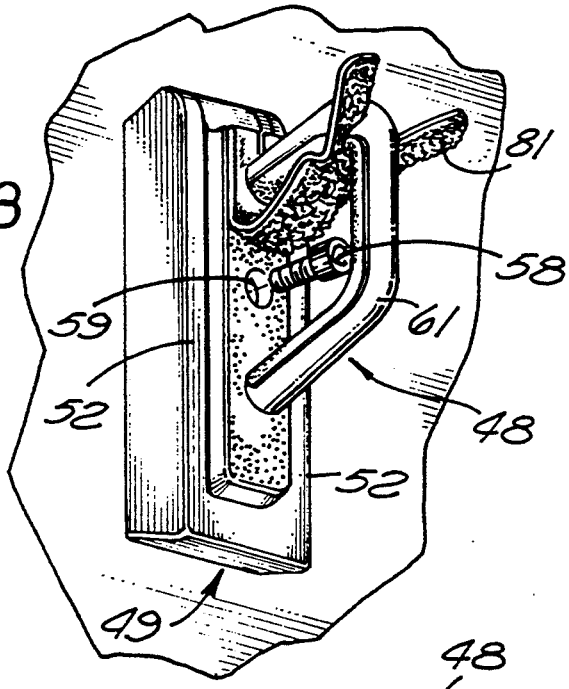
FIG. 8 depicts how the holding member of the fore-end support device is fastened to the base of the fore-end support device.
Figure 11:
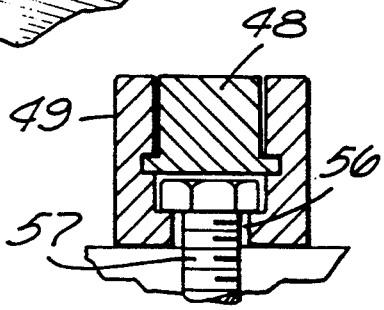
FIG. 11 is a cross-sectional view of the fore-end support device from line 11—11 of FIG. 10.
Figure 9:
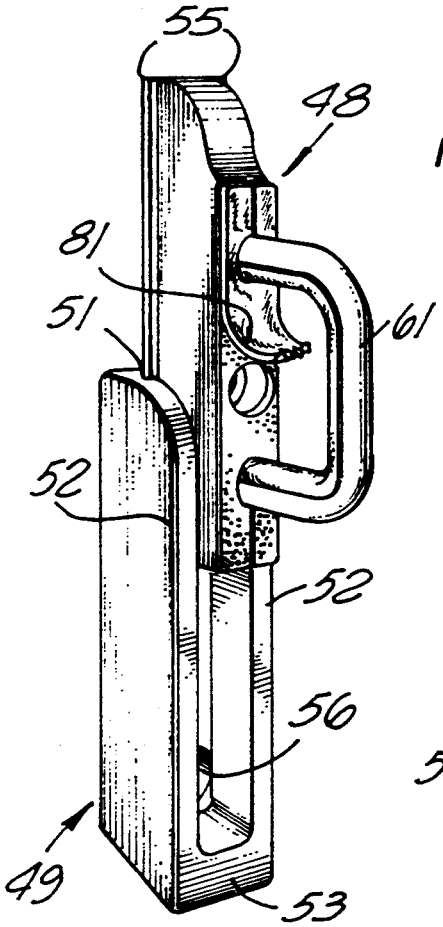
FIG. 9 depicts how the holding member can be slid from the base.

With reference to FIG. 8, the slidable member 48 is fastened to the floor 51 of the base 49 by a threaded bolt 58 through an opening 59 centrally located in the slidable member 48 and a corresponding threaded hole 60 on the base 49. When the bolt 58 is removed, the slidable member 48 can be moved away from the end wall 53, as shown in FIG. 9.

Figure 10:
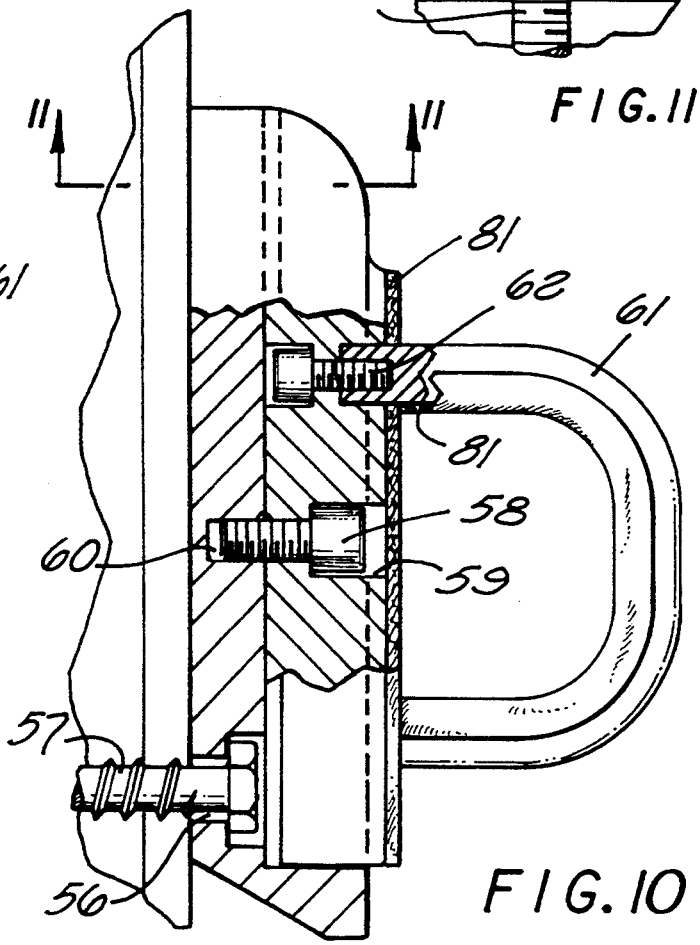
FIG. 10 is a cross-sectional view of the holding member from line 10—10 of FIG. 7.

With reference to FIG. 10, at least two throughholes 56 are provided at the floor 51 of the base 49, each for passage of a screw or bolt 57 for mounting the fore-end support device 4 onto the mounting surface 2. FIG. 10 also shows the bar 61 being fastened to the slidable member 48 by a screw 62 at each end of the bar 61.

The foregoing description of the preferred embodiment is provided for illustrating the principles of the invention. It will be understood by those skilled in the art that various modifications and changes can be made to the preferred embodiment without departing from the principles of the invention.

For example, the slidable member 7, the bar 21 and the hinge 20 of the pivoted member 6, and the lock pin 8 of the locking device 3 are preferably hardened (e.g., heat treated) so that they cannot be sawed open. Similarly, the bar 61 of the fore-end support device 4 is preferably hardened so that it cannot be sawed open.

For another example, the surfaces of the locking device 3 which touch the fire arm (e.g., the surface of the bar 21 and the surface of the hinge 20) can be covered with a layer of soft material 80 (see FIG. 4), such as felt, plastic or leather, to prevent them from scratching the fire arm 1. Similarly, the surfaces of the fore-end support device 4 which touch the fire arm 1 can also be covered with a layer of soft material 81.

What is claimed is:

1. A device for securing a fire arm, comprising:

a base having a floor and two upstanding sidewalls, the floor having at least one hole for passage of a fastener for mounting the device to a mounting surface, each of the sidewalls defining a groove adjacent the floor;

a holding member for holding the fire arm, having means adapted to be slidable between the upstanding sidewalls and having a pair of outwardly-directed flanges slidable in the grooves;

means for fastening the holding member to the base; and wherein each said fastener for mounting the device and said fastening means are inaccessible when the device is in use.

2. A device as in claim 1, wherein the holding member comprises:

a first member which comprises a hinge pivotally mounted to the sidewalls of the base and a bar mounted to the hinge;

a second member slidable in the grooves and adapted to couple with the first member in a locked position to inhibit removal of the fire arm from the device;

a third member for locking the second member in the locked position, comprising a lock pin which locks the second member by passing through a through-hole in a sidewall of the base and a hole in the second member, the lock pin further having a reduced diameter section; and a lock for locking the third member, the lock comprising a hook rotatable to engage the reduced diameter section of the lock pin.

3. A device as in claim 2, wherein the second member has a hole for receiving a tip of the bar of the first member.

4. A device as in claim 1, wherein the base having an upstanding end wall and the holding member has a main body and a U-shape bar with both ends of the U-shape bar being fastened to the main body, and wherein the fastening means comprises a hole for passing a fastener to fasten the holding member to the base.

5. A device for locking a fire arm, comprising:

a base having a floor and two upstanding sidewalls, each of the sidewalls defining a groove adjacent the floor;

a first member affixed to the base;

a second member having flanges slidably received in the grooves, said second member adapted to couple with the first member in a locked position to inhibit removal of the fire arm from the device;

a third member for locking the second member in the locked position; and a lock for locking the third member.

6. A device as in claim 5, wherein the first member is pivotally mounted to the sidewalls of the base.

7. A device as in claim 6, wherein the second member has means for locking the first member to prevent pivotal movement of the first member.

8. A device as in claim 7, wherein the first member has a hinge and a bar forming a U-shape assembly, and wherein the bar has a tip for insertion into a hole in the second member.

9. A device as in claim 7, wherein the second member has a toothed section for coupling with a corresponding toothed section of the first member to thereby lock the first member.

10. A device as in claim 5, wherein the first member comprises a hinge pivotally mounted to the sidewalls of the base and a bar mounted to the hinge.

11. A device as in claim 10, wherein the second member has a hole for receiving a tip of the bar.

12. A device as in claim 5, wherein the third member comprises a lock pin which locks the second member by passing through a through-hole in a sidewall of the base and a hole in the second member.

13. A device as in claim 12, wherein the lock pin has a reduced diameter section for engaging a hook operable by the lock.

14. A device as in claim 5, wherein the first member and the second member couple to surround a portion of the fire arm between two protruding parts thereof to deny passage of either of said two protruding parts therethrough.

15. A device for locking a fire arm, comprising:

a base having a floor and two upstanding sidewalls, each of said sidewalls defining a groove adjacent the floor;

a first member pivotally mounted between the two sidewalls;

a second member having flanges slidable in the grooves and adapted to couple with the first member to prevent removal of said fire arm from the device;

a lock pin for locking the second member;

a lock for locking the lock pin; and wherein the floor has at least two through-holes for passage of fasteners, each through-hole being disposed under at least one of the first member and the second member when the device is in a locked state.

16. A device as in claim 15, wherein the first member has a hinge and a bar forming a U-shape assembly, and wherein the bar has a tip for insertion into a hole in the second member.

17. A device as in claim 15, wherein the second member has a toothed section for coupling with a corresponding toothed section of the first member to thereby lock the first member.

18. An apparatus for mounting a fire arm, comprising:

a locking device as in claim 17; and a supporting device for providing support of the fire arm, comprising:

a base having a floor, two upstanding sidewalls and an end wall, the floor having more than one hole each for passage of a fastener for mounting the device to a mounting surface, each of the sidewalls defining a groove adjacent the floor;

a holding member for holding the fire arm, the holding member adapted to be slidable between the upstanding sidewalls and having a pair of outwardly-directed flanges slidable in the grooves, the holding member having a main body and a U-shape bar with ends fastened to the main body; and means for fastening the holding member to the base.

* * * * *